US006193772B1

(12) United States Patent
Wiefel

(10) Patent No.: US 6,193,772 B1
(45) Date of Patent: Feb. 27, 2001

(54) SELF-PROPELLED HARVESTING MACHINE HAVING A SELECTIVELY ENGAGEABLE SUCTION CLEANING DEVICE OF A FILTER

(75) Inventor: Ute Wiefel, Harsewinkel (DE)

(73) Assignee: Claas Selbstfahrende Erntemaschinen GmbH, Harsewinkel (DE)

( * ) Notice: Subject to any disclaimer, the term of this patent is extended or adjusted under 35 U.S.C. 154(b) by 0 days.

(21) Appl. No.: 09/292,439

(22) Filed: Apr. 15, 1999

(51) Int. Cl.[7] ..... B01D 29/66; B01D 35/143

(52) U.S. Cl. ..... 55/283; 55/301; 55/294; 55/385.3; 55/467; 96/421

(58) Field of Search ..... 55/283, 302, 301, 55/385.3, 295, 296, 297, 294, 467; 96/400, 401, 420, 421, FOR 170; 460/100

(56) References Cited

U.S. PATENT DOCUMENTS 4,542,785 * 9/1985 Bagnall et al. ..... 55/385.3
5,217,512 * 6/1993 Williams ..... 55/290
5,595,537 1/1997 Jungemann et al. .

FOREIGN PATENT DOCUMENTS 0 079 399 B1 9/1996 (EP) .

OTHER PUBLICATIONS

Application 09/163,837 to Isfort et al having filing date Sep. 30, 1998.

* cited by examiner

*Primary Examiner*—David A. Simmons
*Assistant Examiner*—Robert A. Hopkins
(74) *Attorney, Agent, or Firm*—Husch & Eppenberger, LLC; Robert E. Muir

(57) ABSTRACT

A self-propelled harvesting machine includes a drive engine, a cooler and a cooling fan preceded by a cooling-air cleaning device incorporating a filter for retaining dirt particles in the drawn-in cooling-air and also including a suction device for removing said dirt particles, and the cooling-air cleaning device being driven by means of an engageable drive means. One aspect is that the drive means is engaged in dependence on a value measured by sensors. The suction housing and/or the baffle plate is rotatable under gravity or by being motor driven, when the suction device is switched off, into a position covering a region associated with the lower part of the filter device.

15 Claims, 2 Drawing Sheets

SELF-PROPELLED HARVESTING MACHINE HAVING A SELECTIVELY ENGAGEABLE SUCTION CLEANING DEVICE OF A FILTER

BACKGROUND OF THE INVENTION

The invention relates generally to agricultural equipment and more particularly to improvements in self-propelled harvesting machines which include a prime mover, a cooler and a cooling fan.

The operation of a harvesting machine often results in the formation of considerable dust and particles in the surrounding air. At the same time, such a harvesting machine must suck in a large amount of air in order to adequately cool the engine, which these days may have a power of 400 kW or more. In the harvesting machines being considered here, one has to ensure that any rotating suction device and any additional baffle plate sweep the outer surface of the filter to release and remove all the dirt particles adhering to the surface of the filter. This will then prevent the pores of the filter from becoming so clogged with dirt particles over the time period for which the machine is used that insufficient cool air can flow through the openings in the filter. As used herein, the terms "dirt", "particles" or "dirt particles" are intended to be generic and cover, for example, dust, chaff, particles of dirt, and particles of crop. The surfaces of the filter may additionally be swept from the inside by a baffle plate or be covered thereby. Such a device is known from EP 0 079 399.

That said, there is not much point in causing the cleaning device for the filter to be operated if the cooling-air does not really need to be cleaned. This is the case for example when travelling along the highway. Under certain circumstances, it is also possible for the number of dirt particles formed during harvesting to be so greatly reduced that it is no longer necessary to continuously apply suction to the surface of the filter. Operation of the suction device would then expend unnecessary energy and the rotating elements would be subjected to unnecessary wear and tear.

It is also known for cleaning devices to be switched on for cleaning the air filters in dependence on the operation of a member in the harvesting machine. Such a switching operation may be unsatisfactory from two points of view: the cleaning device may be operated during harvesting even though this may be unnecessary due to the small amount of dust being created; when travelling along the highway, the cleaning device may be switched off even though the harvesting machine may, for example, while driving along or having just left the fields, have sucked in some of the dirt deposited thereon so that the air filter really should be cleaned. In the case of forage harvesters in particular, the air cleaning device is located just above the base of a so-called maintenance chamber. Dirt particles inevitably collect on this base when the harvester is working in the fields. These particles are then sucked into the cooling fan when travelling along the highway and embed themselves in the filter device thereby substantially reducing the through flow of air.

It is an object of the present invention to overcome one or more of the problems discussed above.

Starting from a self-propelled agricultural machine including an air cleaning device of the type described above, the object of the invention is to reduce the time for which the cleaning device is operated.

These, and other objects and advantages of the present invention, will become apparent as the same becomes better understood from the following detailed description when taken in conjunction with the accompanying drawings.

SUMMARY OF THE INVENTION

In accordance with the present invention there is provided a self-propelled machine including a drive engine, a heat exchanger associated with the engine, a cooling fan for passing cooling air through the heat exchanger, a filter device incorporating a filter for retaining particles carried by the drawn-in cooling air, a cleaning device for removing said particles from the filter, means for driving one of said devices, and means for selectively engaging the means for driving.

One object is achieved either in that the drive means for the air cleaning device is engaged in dependence on a value measured by a sensor, or that the suction housing and/or a baffle plate is rotatable under gravity, or by being motor driven, when the suction function is switched off, into a position covering a region associated with the lower part of the filter device.

In a first alternative, a value is obtained by a sensor, e.g. a pressure sensor for measuring the air pressure in the suction region of the cooling fan or a temperature sensor for measuring the temperature of the cooling water, whereby this value indicates whether sufficient cooling-air is being drawn through the air cleaning device. If the measured value falls below, or rises above, a critical limiting value then the drive means for the air cooling device is switched on. The sensor then monitors the variation in this measured value and switches off this drive means once it lies in a non-critical range. This procedure thus allows the air cooling device to be operated only when it is really necessary. Energy and drive power are thereby saved whilst the relevant parts of the machinery are not subjected to unnecessary wear-and-tear. In the case of the second alternative, the lower part of the filter device is covered when the air cleaning device is switched off, or at least, when its suction power is switched off. Cooling-air is thereby sucked in preferentially from the upper layers of air that are not so enriched with dirt particles as the air close to the ground around the harvesting machine. The filter device thus does not clog up so quickly whilst, depending on the amount of dirt, the air cleaning device does not have to be turned on so frequently or may not need switching on at all, such as when travelling along the highway, even if dirt particles have collected on the harvesting machine in front of the air intake openings.

Although a common drive means is preferably used for the air cleaning device, especially the rotating or fixed filter element, the rotating or fixed suction housing and the rotating or fixed baffle plate, several separate drive means may be used. The suction housing and/or the baffle plate can be rotated into a position covering a part of the filter device associated with the lower part thereof in a particularly simple manner by using gravity. By appropriate design of the suction housing and the baffle plate, the spacing of their centers of gravity from the rotational axis can be made such that the centers of gravity level out in a vertical projection of the rotational axis when the drive means is switched off. This thus prevents dirt on the base of the maintenance chamber from being sucked through the filter device due to the suction effect of the cooling fan thereby blocking the openings in the filter device. The driver is not burdened with extra work due to such a design of the suction housing and the baffle plate. The mounting of the suction housing and the baffle plate could also be referred to as being off-center.

One particularly simple construction is obtained if the suction housing has an angular section in a direction extending along its rotational axis and is rectangular when viewed along this rotational axis. A part of the end face and of the peripheral surface of the sieve device corresponding thereto is covered as a result of this design. In order to ensure the proper functioning of the baffle plate, it is expedient if this has an angular section in a direction extending along its rotational axis and is in the form of a segment when viewed along this rotational axis. An adequate area of the sieve or filter device can then be screened from the suction effect of the cooling fan by appropriate choice of angle for the segment. It is expedient if said area covers an angle of approximately 60 degrees. Correct functioning is ensured in advantageous manner if provision is made for the suction housing and the baffle plate to extend substantially from the central mid-axis up to the outer edge region of the filter device.

BRIEF DESCRIPTION OF THE DRAWINGS

Reference is now made more particularly to the drawings which illustrate the best presently known mode of carrying out the invention and wherein similar reference characters indicate the same parts throughout the views.

DETAILED DESCRIPTION

Figure 1:
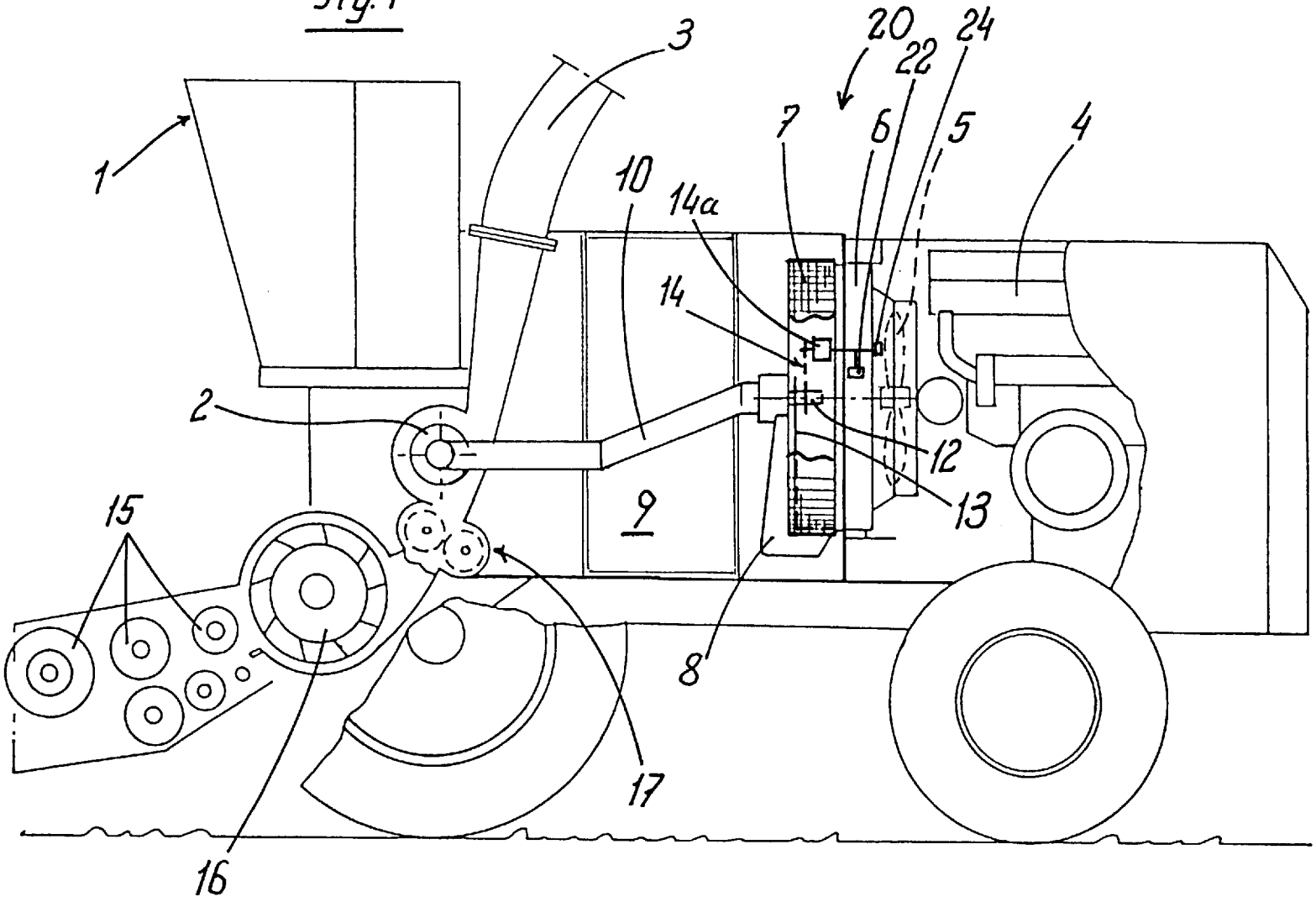
FIG. 1 shows a schematic, side view of a self-propelled harvesting machine in the form of a forage harvester having its side panels removed.

The agricultural machine illustrated in FIG. 1 is a self-propelled forage harvester 1 equipped with a chopping device which will be described later in more detail and which itself is equipped at its outlet end with a supplementary accelerating device in the form of a blower or accelerator 2 for conveying the chopped material with sufficient velocity into a curved discharge chute 3 from where it is deposited into a transporter, such as a truck or wagon, moving alongside the forage harvester 1. In addition, the forage harvester 1 is equipped with a drive engine 4 in the form of a diesel engine. A rotating cooling fan 5 having a cooler or heat exchanger 6 on one side or the other is provided at the end of an air cleaning device 20 facing the discharge chute 3. A filter device 7 is arranged directly in front of the cooler 6 on the side of the air cleaning device 20 remote from the drive engine 4 but facing the discharge chute 3. The casing of the filter device 7 and the end-wall facing the discharge chute 3 may be made of e.g. wire netting or a perforated plate, or some other form of sieve or filtering means may be employed. In one embodiment, a housing 8 is attached to the filter device 7 on the side thereof facing the discharge chute 3, said housing being rotatably driven about the central mid-axis of the filter device 7 in a manner hereinafter described in more detail. Other arrangements are known in which the housing 8 is static whereas the filter device 7 is rotatable.

Figure 3:
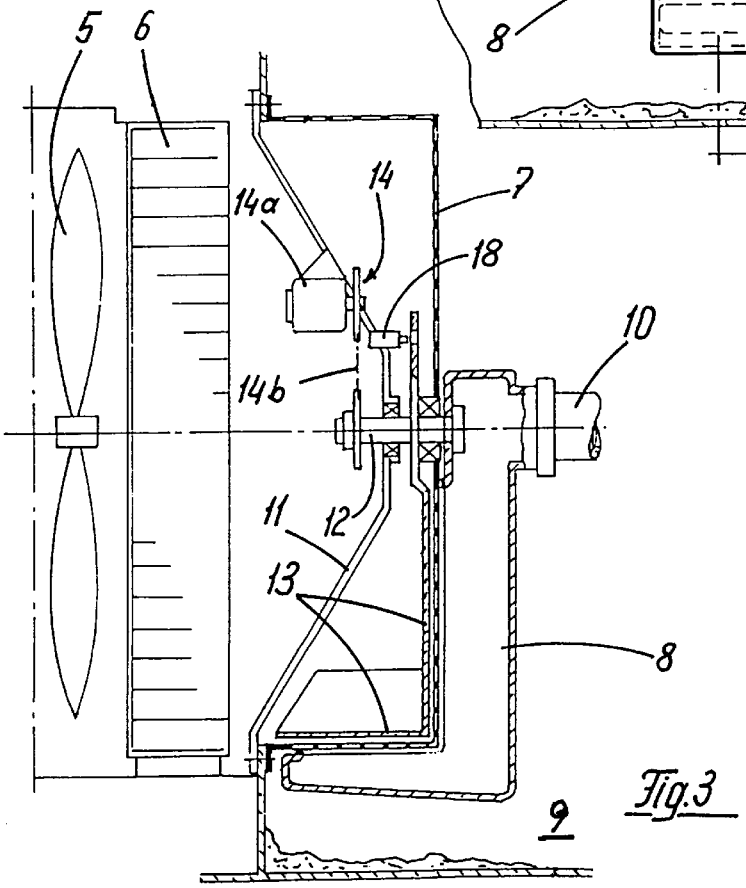
FIG. 3 is a sectional view taken generally along the line III—III in FIG. 2 and seen from the side opposite that in FIG. 1.

As can be seen in FIG. 3, this housing 8 has an approximately angular section in a direction extending along its rotational axis so that that region thereof which is approximately parallel to the rotational axis of the housing 8 overlaps the casing of the filter device 7 in correspondence with the width of the housing 8. A maintenance chamber 9 for the forage harvester 1 is located between the filter device 7 and the discharge chute 3. The housing 8 is connected to the blower 2 through flow tubing 10. A partial vacuum created by the blower 2 is conveyed via the tubing 10 to the housing 8.

Figure 2:
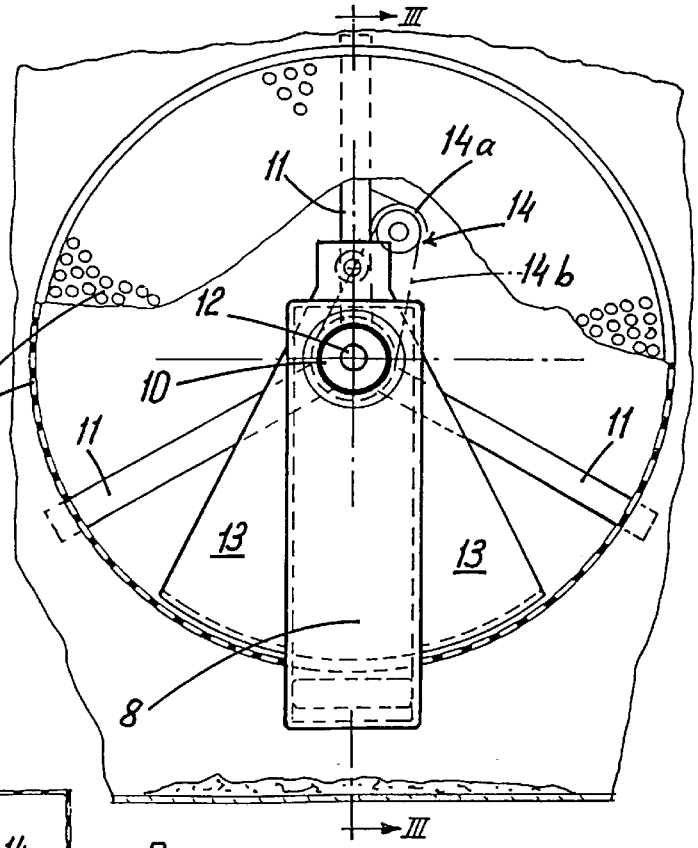
FIG. 2 is an end view of the sieve device from the side opposite the drive engine and with portions of the filter device broken away for a better illustration of the parts.

As is depicted in FIGS. 1 and 2, the tubing 10 is attached to the housing 8 in the vicinity of the central mid-portion of the filter device 7. As depicted particularly in FIG. 3, the area of the housing 8 facing the filter device 7 is open so that a vacuum for sucking out the dirt particles is effective on the corresponding surfaces of the casing and the end-wall of the filter device 7. The housing 8 is rigidly attached to a shaft 12. A baffle plate 13 in the form of a segment is also rigidly attached to the shaft 12 at a point spaced by a relatively small amount from the end-wall of the filter device 7. Three equiangularly spaced braces 11 are provided within the pot-shaped filter device 7. Drive means 14 is mounted on one of the braces 11 for rotating the shaft 12 and hence the housing 8 and the baffle plate 13. In essence, this drive means 14 consists of an electric motor 14*a* and a chain or belt drive 14*b* of which one wheel is rigidly attached to the spindle of the electric motor 14*a* and the other wheel is rigidly attached to the shaft 12. However, in another embodiment, the drive means 14 could also comprise a hydraulic drive which is switched on and off by means of a hydraulic valve, or be provided with a belt drive having a clutchable drive pulley or some other form of actuatable drive. The baffle plate 13 has an angular section in a direction extending along the shaft 12 and is in the form of a segment when viewed along this rotational axis.

As is depicted particularly in FIG. 2, the baffle plate 13 extends over a range of approximately 60 degrees over the inner surface of the casing of the filter device 7. The front wall area of housing 8 (i.e. that on the other side of the filter device 7 and opposite the baffle plate 13) is likewise air permeable and is in the approximate shape of a triangle (i.e. complementary to the baffle plate 13).

At its front, the forage harvester 1 is equipped in known manner with a crop material input arrangement 15 having the chopper mechanism 16 attached thereto. The crop material passes from the chopper 16 to a pair of conditioning rollers 17 where it is chopped. The supplementary accelerating device in the form of the blower 2 is provided after the pair of conditioning rollers 17 for ensuring that the chopped material is properly conveyed to a transporter moving alongside the forage harvester 1.

The cooling fan 5 is driven by the drive engine 4 in any convenient manner during normal operation of the harvester. A thermostatically controlled, electric motor driven cooling fan 5 may also be used. When the cooling fan 5 draws or expels (depending on its design) cooling air through the cooler 6, it also draws this air through the air cleaning device 20. This air therefore also passes through the filter device 7. If there are foreign bodies on the mesh of the filter device 7, they prevent the free passage of air and reduce the amount of air passing through the cooler 6. The performance of the cooler 6 is thus reduced and the temperature of the coolant increases. At the same time, whether the cooling fan 5 is of the drawing or expelling type, the partial vacuum between the filter device 7 and the cooling fan 5 increases as the filter device 7 becomes increasingly blocked. As shown in FIG. 1, the increase in temperature of the coolant water can be measured by means of a temperature sensor or thermometer 22; while the partial vacuum between the filter device 7 and the cooling fan 5 can be measured by means of a pressure sensor 24. The values measured by these sensors 22, 24 may thus be used as a measure for the degree of blockage of the filter device 7. For this purpose, the sensors 22, 24 are connected to the drive means 14 via an electrical cable over which the measured values are directly or indirectly conveyed from the sensors to the drive means 14. The drive means 14 itself may be equipped with an electronic processor (microprocessor) or this processor may be at some other location on the harvesting machine. The values measured by the sensors 22, 24 are compared with stored limiting values and the drive means 14 is switched on or off when these limits are reached. When the drive means 14 is switched on, the suction housing 8 of the present embodiment rotates, although in other embodiments, it may be the filter device 7 and/or any available baffle plate 13 which rotates. Due to the through-flow connection of the blower 2 to the housing 8 via the tubing 10, the suction housing 8 is subjected to a vacuum whereby the filter device 7 is cleaned on a continual basis. In a departure from the device described here for producing the vacuum, other such known devices may of course be employed in other harvesting machines.

Once harvesting has finished, the whole chopping mechanism 17, etc. is turned off when running empty. In existing machines, whether the drive means 14 is also switched off depends on whether the operating mechanism of the harvesting machine 1 is on or off. In contrast, in the present embodiment the operational state of the drive means 14 is determined by the values measured by the sensors 22, 24.

Since a vacuum is not produced when the blower 2 is switched off, the suction housing 8 is then no longer subject to a vacuum. In the absence of such a vacuum, other arrangements have to be made to prevent the filter device 7 from being blocked by the dirt being sucked in. As is particularly depicted in FIGS. 2 and 3, dirt may accumulate on the base of the maintenance chamber 9. The tires of the harvesting machine or other agricultural equipment traveling nearby may also throw up dirt which is then sucked in by the cooling fan 5. Whatever the case, the air sucked in will be dirtier the nearer to the ground at which it is drawn in. Said dirt accumulating on the base of the maintenance chamber 9 is sucked in from a point close to the ground. Consequently, the amount of dirt clinging to the filter device 7 would be substantially reduced if the air were only to be sucked in at a higher point. This is achieved by covering the lower region of the filter device 7 by means of the suction housing 8 and/or the baffle plate 13. Since, in the present embodiment, the centers of gravity of the suction housing 8 and the baffle plate 13 are off-center relative to the points at which they are mounted, these elements are always inclined to move under the effects of gravity into a position in which they adopt a depending or hanging position once the drive means 14 is switched off. In this position, the centers of gravity are located vertically below and spaced from a rotational axis defined by the shaft 12. Due to the planar form of the suction housing 8 and the baffle plate 13, the lower region of the filter device 7 is thereby so covered that air is no longer sucked through this region of the filter device. Instead of moving the suction housing 8 and the baffle plate 13 under the passive influence of gravity, these elements could of course also be driven by a motor and stopped at a position in which they cover the lower region of the filter device 7.

FIGS. 2 and 3 show that the region below and to the side of the housing is not affected by the suction produced by the cooling fan 5 so that the particles remain on the base of the maintenance chamber 9. The driver can therefore travel in traffic without having to switch on the blower 2 or the drive means 14. Additional manual operations are not therefore required.

The baffle plate 13 conveniently extends upwardly beyond its rotational axis. A locking device 18 rigidly attached to a brace blocks the baffle plate 13 and therefore the housing 8 when the drive means 14 is switched off. This locking device could, for example, be solenoid operated and whose plunger travels through a boring in the baffle plate 13. Unwanted pendulum movements of the housing 8 and the baffle plate 13 are thereby prevented.

The explanations provided above should be understood as being merely exemplary. The skilled person would have no difficulty in transferring the inventive concept described above to other self-propelled machines, especially, harvesting machines or to other machines used in forestry work or the building industry. In so doing, the skilled person would consider the extent to which the proposed solutions require modification so as to be suitable for his purposes. The skilled person will use his knowledge, in particular regarding the electronic control and processing of the sensor signal, in order to locate an appropriate device for his particular field of application.

While a preferred embodiment of the invention has herein been illustrated and described, this has been done by way of illustration and not limitation, and the invention should not be limited except as required by the scope of the appended claims.

I claim:

1. A self-propelled machine including a drive engine, a heat exchanger associated with the engine, a cooling fan for passing cooling air through the heat exchanger, a filter device incorporating a filter for retaining particles carried by the drawn-in cooling air, a cleaning device for removing said particles from the filter, the cleaning device including a suction housing in communication with only a portion of the filter at a time, means for driving one of said devices, means for selectively engaging the means for driving, said suction housing being rotatably mounted to selectively communicate with the entire filter during each rotation, and said suction housing being rotatable under gravity to a non-moving position in which a lower portion of the filter is protected from ingesting dirt particles.

2. A self-propelled machine in accordance with claim 1, wherein said means for driving is in communication with a sensor, said sensor transmitting a value to said means for driving to control said means for driving.

3. A self-propelled machine in accordance with claim 1, wherein the suction housing includes an angular section in a direction extending along its rotational axis and is rectangular when viewed along this rotational axis.

4. A self-propelled machine in accordance with of claim 1, further including a baffle plate, wherein the suction housing and the baffle plate extend substantially from the rotational axis out to the outer edge region of the filter device.

5. A self-propelled machine including a drive engine, a heat exchanger associated with the engine, a cooling fan for passing cooling air through the heat exchanger, a filter device incorporating a filter for retaining particles carried by the drawn-in cooling air, a cleaning device for removing said particles from the filter, the cleaning device including a suction housing in communication with the filter, means for driving one of said devices, means for selectively engaging the means for driving, and wherein said means for driving moves the suction housing into a position covering a region associated with the lower part of the filter device when the cleaning device is switched off.

6. A self-propelled machine including a drive engine, a heat exchanger associated with the engine, a cooling fan for passing cooling air through the heat exchanger, a filter device incorporating a filter for retaining particles carried by the drawn-in cooling air, the filter including a generally circular surface and a circumfrential end-wall, a rotatable shaft extending through the filter at the center of the circular surface, a cleaning device attached to the shaft adjacent the filter and for removing said particles from the circular surface and end-wall of the filter, means for driving the shaft, means for selectively engaging the means for driving, and an L-shaped baffle plate attached to the shaft on the side of the filter opposite the cleaning device, so as to allow the baffle plate to rotate with the cleaning device.

7. A self-propelled machine in accordance with claim 6, wherein the baffle plate includes an angular section in a direction extending along its rotational axis and is in the form of a segment when viewed along this rotational axis.

8. A self-propelled harvesting machine in accordance with claim 6, wherein said baffle is rotatable under gravity.

9. A self-propelled machine in accordance with of claim 6, wherein the baffle plate extends over an angle of approximately 60 degrees within the filter device.

10. A self-propelled machine including a drive engine, a heat exchanger associated with the engine, a cooling fan for passing cooling air through the heat exchanger, a filter device incorporating a filter for retaining particles carried by the drawn-in cooling air, a cleaning device for removing said particles from the filter, means for driving one of said devices, means for selectively engaging the means for driving, a baffle plate attached to a shaft, said shaft attached through the filter so as to allow the baffle to rotate within the filter, and said baffle being motor driven when the suction device is switched off into a position covering a region associated with the lower part of the filter device.

11. A self-propelled machine including a drive engine, a heat exchanger associated with the engine, a cooling fan for passing cooling air through the heat exchanger, a filter device incorporating a filter for retaining particles carried by the drawn-in cooling air, a cleaning device for removing said particles from the filter, the cleaning device including a suction housing in communication with the filter, means for driving one of said devices, means for selectively engaging the means for driving, a baffle plate, and wherein the suction housing and the baffle plate are blocked by a locking device when the means for driving is switched off.

12. A self-propelled machine including a drive engine, a heat exchanger associated with the engine, a cooling fan for passing cooling air through the heat exchanger, a filter device incorporating a filter for retaining particles carried by the drawn-in cooling air, a cleaning device including a suction device for removing said particles from the filter, means for driving said suction device, means for engaging the means for driving, and the suction device being movable to a depending position covering a lower portion of the filter when the suction device is switched off.

13. A self-propelled machine as set forth in claim 12, including a baffle plate on the other side of the filter from the suction device and being driven along with the suction device.

14. A self-propelled machine as set forth in claim 13, wherein the baffle plate and suction device are moved to the depending position when the suction device is switched off under force of gravity.

15. A self-propelled machine as set forth in claim 13, wherein the baffle plate and suction device are driven to the depending position when the suction device is switched off by the means for driving.

* * * * *